US006952673B2

(12) United States Patent
Amir et al.

(10) Patent No.: US 6,952,673 B2
(45) Date of Patent: Oct. 4, 2005

(54) SYSTEM AND METHOD FOR ADAPTING SPEECH PLAYBACK SPEED TO TYPING SPEED

(75) Inventors: Arnon Amir, Cupertino, CA (US); Michael Rodeh, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 765 days.

(21) Appl. No.: 09/789,452

(22) Filed: Feb. 20, 2001

(65) Prior Publication Data

US 2002/0116188 A1 Aug. 22, 2002

(51) Int. Cl.[7] ..... G10L 15/26

(52) U.S. Cl. ..... 704/235; 704/211; 704/207; 179/100.1 R; 179/100.1 VC

(58) Field of Search ..... 704/211, 207, 704/235, 272, 231, 201, 260; 179/100.1 R, 100.1 VC; 341/22; 715/534

(56) References Cited

U.S. PATENT DOCUMENTS 3,829,621 A * 8/1974 Goldman ..... 369/20
4,041,467 A * 8/1977 Cota et al. ..... 715/534
4,075,435 A 2/1978 Eppler, Jr. ..... 179/100.1
4,207,440 A 6/1980 Schiffman ..... 179/100.1
4,337,375 A * 6/1982 Freeman ..... 704/260
4,908,866 A * 3/1990 Goldwasser et al. ..... 704/201
5,721,827 A * 2/1998 Logan et al. ..... 709/217
5,828,994 A * 10/1998 Covell et al. ..... 704/211
6,263,308 B1 * 7/2001 Heckerman et al. ..... 704/231
6,424,946 B1 * 7/2002 Tritschler et al. ..... 704/272
6,490,553 B2 * 12/2002 Van Thong et al. ..... 704/211
6,505,153 B1 * 1/2003 Van Thong et al. ..... 704/211
6,621,424 B1 * 9/2003 Brand ..... 341/22

* cited by examiner

*Primary Examiner*—Susan McFadden
*Assistant Examiner*—Huyen X. Vo
(74) *Attorney, Agent, or Firm*—John L. Rogitz

(57) ABSTRACT

A system and method for automatically adjusting the rate at which recorded speech is played back as a typist manually transcribes the speech. The typing speed is measured and a speech playback rate determined based on the measured speed. The playback rate of the audio is then automatically increased or decreased as appropriate to match the typing speed.

60 Claims, 2 Drawing Sheets

SYSTEM AND METHOD FOR ADAPTING SPEECH PLAYBACK SPEED TO TYPING SPEED

BACKGROUND OF THE INVENTION

1. Field of the Invention

The present invention relates generally to adjusting the playback rate of recorded audio based on the typing speed of a typist transcribing the audio.

2. Description of the Related Art

It is often desirable to transcribe speech into alphanumeric characters. In this way, the speech can be input into a computer or otherwise reproduced in written form for a variety of purposes.

Conventionally, a typist listens to a recording of a speech and simultaneously transcribes the speech using a typewriter or computer keyboard. As recognized herein, such manual transcription remains common even with the advent of speech recognition devices, since much speech that has been transcribed by a speech recognition device might still require manual editing.

Typically, the typist starts and stops the audio device as necessary to keep up with the audio, since the typist ordinarily types at a speed that is independent of the playback rate of the audio. Consequently, a slow typist must continually start and stop the audio, which is cumbersome, inefficient, and annoying, while a fast typist must wait for the audio and thus be forced to slow an otherwise fast and efficient typing speed down to the playback rate of the audio. Moreover, the problem is exacerbated by the fact that different speakers can speak at different rates.

U.S. Pat. Nos. 4,207,440 and 4,075,435 disclose methods for dictation machine playback control. Unfortunately, neither of these inventions makes the critical observation that audio playback rate can be automatically and dynamically established based on actual typing speed. U.S. Pat. No. 5,649,060 (and other related patents, such as U.S. Pat. Nos. 6,076,059, 5,333,275, and 5,136,655) provide aligning speech to text but do not consider adapting speech playback rate to typing rate. Also, the above-noted patents require an existing text transcript, which might not be present in the cases considered herein.

The present invention has considered the above problem of recorded audio not being played at the rate at which a user transcribes it, and has made the critical observation that it would be beneficial to automatically establish the audio playback rate based on the actual speed at which a typist transcribes it.

SUMMARY OF THE INVENTION

The invention is a general purpose computer programmed according to the inventive steps herein. The invention can also be embodied as an article of manufacture—a machine component—that is used by a digital processing apparatus and which tangibly embodies a program of instructions that are executable by the digital processing apparatus to undertake the logic disclosed herein. This invention is realized in a critical machine component that causes a digital processing apparatus to undertake the inventive logic herein.

In one aspect, a computer-implemented method is disclosed for facilitating efficient transcription of audible speech from an audio system. The method includes measuring a typing speed and generating a signal based on the typing speed. Using the signal, a playback rate at which the audible speech is played by the audio system is established, preferably by reading ahead audio before it is played and applying the dynamically established playback rate to it.

In a preferred embodiment, the signal represents a playback rate correction. The rate can be established at least in part by detecting a user-initiated pause in the audio system, and in response thereto reducing the playback rate. Also, the rate can be established at least in part by detecting a continuous period of typing at least a first predetermined time period in length characterized by having pause periods all less than a second predetermined time period, and in response increasing the playback rate. Still further, the method contemplates establishing the rate by determining a number of words or phonemes or characters typed per a unit time (including approximations thereof), and establishing the playback rate based thereon. The playback rate can be either increased or reduced. The speech speed can be determined by preprocessing well in advance of transcription time or with just a small window of delay.

As disclosed in detail below, in certain preferred embodiments the method can include detecting a typing pause having at least a predetermined duration, and automatically stopping playback of the audio in response thereto. One preferred method can include detecting a stroke of a delete key or backspace key, and then causing the audio system to replay audio in response to the stroke.

In another aspect, a computer program product is disclosed to undertake logic for dynamically establishing a playback rate of an audio system. The logic includes logic means for receiving manual input representing a transcription of audio having a playback rate. Also, logic means are provided for determining a typing speed based on the means for receiving. Moreover, logic means use the typing speed to establish a playback rate.

In still another aspect, an audio transcription computer system includes a computer that in turn includes a module having logical structure to determine typing speed. An audio system receives feedback representative of typing speed from the computer and in response applies an audio playback rate to audio. The preferred audio system can include at least one time scale modification device that applies the playback rate to audio, and the feedback from the module establishes the playback rate.

The details of the present invention, both as to its structure and operation, can best be understood in reference to the accompanying drawings, in which like reference numerals refer to like parts, and in which:

DETAILED DESCRIPTION OF THE PREFERRED EMBODIMENTS

Figure 1:
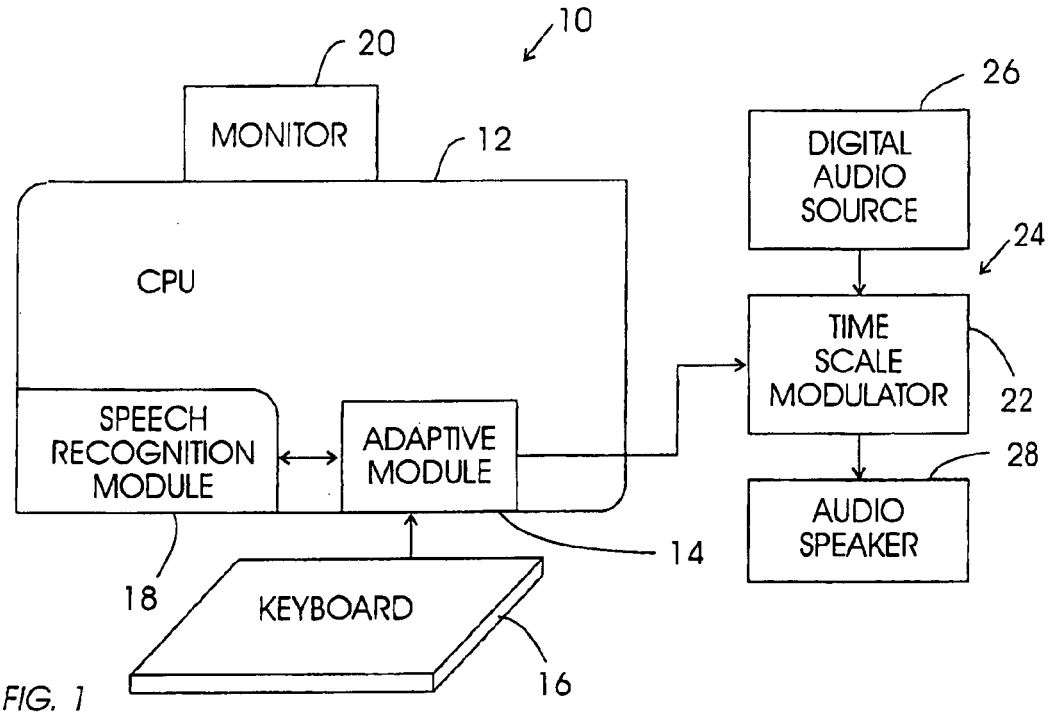
FIG. 1 is a schematic diagram of the present system.

Referring initially to FIG. 1, a system is shown, generally designated 10, which includes a digital processing apparatus, such as a computer or processor 12, which has an adaptive module 14 that embodies the logic disclosed herein.

In one intended embodiment, the computer 12 may be a personal computer made by International Business Machines Corporation (IBM) of Armonk, N.Y., or it may be any computer, including computers sold under trademarks such as AS400, with accompanying IBM Network Stations. Or, the computer 12 may be a Unix computer, or IBM workstation, or an IBM laptop computer, or a mainframe computer, or any other suitable computing device, such as an ASIC chip.

The module 14 may be executed by a processor as a series of computer-executable instructions. These instructions may reside, for example, in RAM of the computer 12.

Alternatively, the instructions may be contained on a data storage device with a computer readable medium, such as a computer diskette having a data storage medium holding computer program code elements. Or, the instructions may be stored on a DASD array, magnetic tape, conventional hard disk drive, electronic read-only memory, optical storage device, or other appropriate data storage device. In an illustrative embodiment of the invention, the computer-executable instructions may be lines of compiled $C^{++}$ compatible code. As yet another equivalent alternative, the logic can be embedded in an application specific integrated circuit (ASIC) chip or other electronic circuitry. It is to be understood that the system 10 can include peripheral computer equipment known in the art, including output devices such as a video monitor or printer and input devices such as a computer keyboard and mouse. Other output devices can be used, such as other computers, and so on. Likewise, other input devices can be used, e.g., trackballs, keypads, touch screens, and voice recognition devices.

As shown in FIG. 1, the computer 12 receives input via a manual input device such as a keypad or keyboard 16. If desired, the computer 12 can also access a speech recognition module 18 that can be any appropriate speech recognition device known in the art. The computer 12 can also include an output device such as a monitor 20.

As disclosed in detail below, the adaptive module 14 measures the speed at which characters are input by means of the keyboard 16, and then outputs a signal to a time scale modification device 22 of a preferably digital audio system 24 including a source 26 of digital audio and an audio speaker 28. The signal from the module 14 that is input to the time scale modification device 22 causes the device 22 to speed up or slow down the playback rate of the audio, as appropriate for the measured typing speed. In one preferred embodiment, the time scale modification device 22 is the Waveform Similarity Overlap (WSOLA) disclosed in Verhelst et al., "An Overlap-Add Technique based on Waveform Similarity (WSOLA) for High Quality Time-Scale Modification of Speech", IEEE Int'l Conf. on Acoustics, Speech, and Signal Processing, vol. II, 1993.

Figure 2:
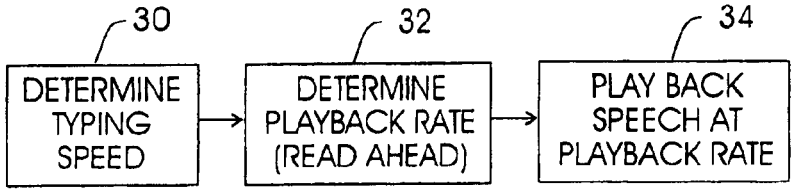
FIG. 2 is a flow chart showing the overall logic of the present invention.

FIG. 2 shows the overall logic of the present invention as might be embodied in software. Commencing at block 30, the speed at which a typist is manually transcribing speech being audibly played by the system 24 is determined. The present invention contemplates any suitable way to determine typing speed, such as but not limited to determining the number of words being typed per unit time. Or, the number of characters or phonemes typed per unit time can be determined. Still further, the number of times the space bar and enter key are depressed per unit time can be counted, and a typing rate can be based thereon. User commands can be entered by means other than keystrokes. Each word in recognized speech can be assigned to a respective expected typing duration by a predetermined user, for facilitating estimating the typing rate. Approximations of the above can also be made. In any case, a signal is output by the adaptive module 14 that represents the typing speed and, hence, desired audio playback rate.

Moving to block 32, based on the typing speed, an audio playback rate is determined, preferably for an audio segment that is about to be played and thus that is read ahead. In another embodiment, both speech speed and typing speed are measured, and the speech speed is adapted accordingly. The audio playback rate can be set so that the speech rate is equal to the typing speed, in one embodiment. Speech speed can be measured by counting the number of phonemes per unit time or by counting spoken words per unit time (either using phoneme recognition, phoneme segmentation, speech recognition, or by detecting and counting pauses between words per unit time).

It is to be understood that the steps in FIG. 2 do not have to be performed in the order shown. For instance, the speech speed can be measured long before transcription time or just before. In any case, a signal is output by the adaptive module 14 that represents the desired audio playback rate or a desired change (faster or slower) therein.

At block 34, the signal is output to the time scale modification device 22 to cause the device 22 to apply the playback rate to the read ahead audio and thus to play back audio broadcast by the audio speaker 28 at the desired play back rate. In this way, the playback rate of the audio system 24 is automatically and dynamically established based on actual the typing speed of a user transcribing the audio by means of the keyboard 16. This can be done by time scale modification (TSM), inserting pauses between words, inserting pauses between sentences, combinations of the above, etc.

Figure 3:
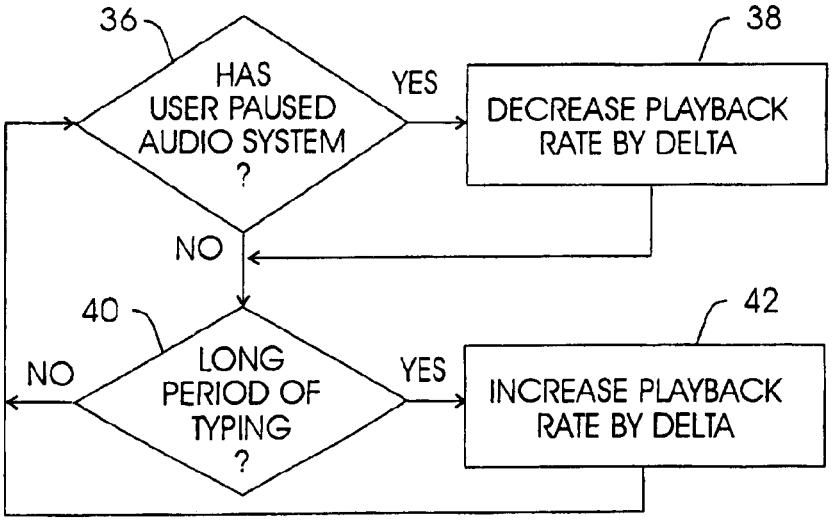
FIG. 3 is a flow chart of one method for determining typing speed.

FIG. 3 shows that alternatively, the playback rate can be initialized at a default value (e.g., the original speaking rate) and then, commencing a continuous monitoring loop at decision diamond 36, it is determined whether the user has paused the audio system 24, either at all or for longer than a predetermined period. If so, the playback rate is automatically decreased at block 38 by a either a constant delta amount or by a delta amount that depends on the length of the pause.

The lines from states 36 and 38 to decision diamond 40 simply indicate that the monitoring loop also detects a long period of uninterrupted typing. This period is characterized by being at least a first predetermined time period in length, with any pause periods therein all being less than a second predetermined time period. In response to detecting such a continuous period, the playback rate is increased at block 42. The lines leading back to decision diamond 36 indicate that the above-described monitoring loop is continuous.

Figure 4:
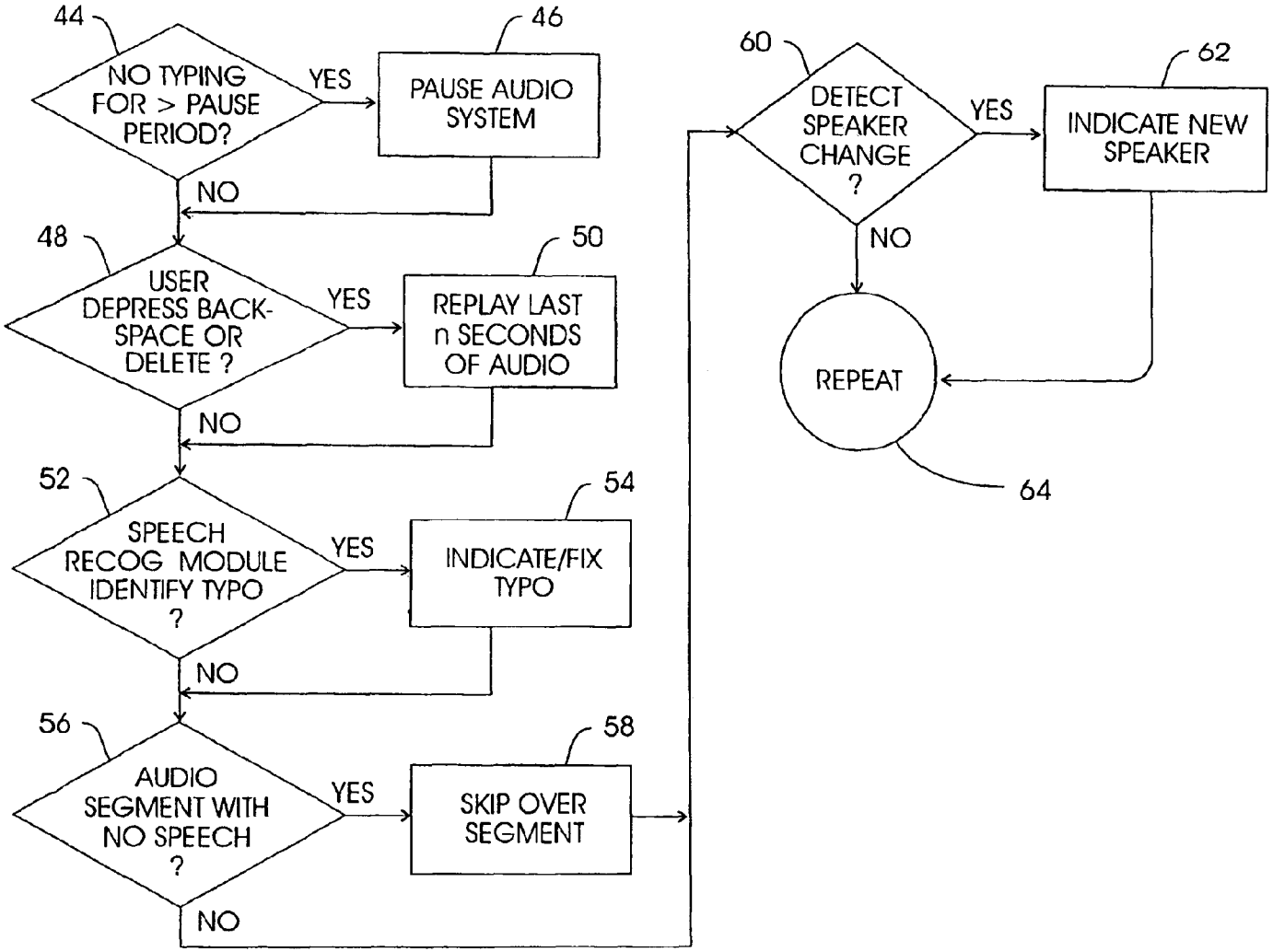
FIG. 4 is a flow chart showing various preferred features of the present logic.

FIG. 4 shows various other features that can be included in the adaptive module 14. Commencing a continuous monitoring loop at decision diamond 44, it is determined whether the user has ceased typing for longer than a predetermined pause period. If so, the audio system 24 is automatically paused at block 46.

The preferred monitoring loop can also undertake decision diamond 48, wherein when the typist depresses the backspace key, delete key, or other similar key such as a command or function key, the previously played "n" seconds of audio are replayed at block 50. That is, a user's typing behavior is detected and the speech playback rate is controlled in response thereto. When a speech recognition module 18 is provided, the logic can also determine at decision diamond 52, by comparing the output of the module 18 with what has been typed, whether any typographical error has been committed by the typist. If so, the error can be automatically corrected or indicated, as by highlighting, at block 54. Moreover, when a speech recognition module is provided and speech speed is measured, the words that are typed can be compared with the words that are spoken and pause/replay the speech if the gap is too long. Finding the match between typed words and speech can be done using word to word comparison of typed text and speech recognition module output, or by converting the typed text to a stream of phonemes and comparing them with the phonemes extracted from the speech. By finding the match between typed text and spoken words, the system can indicate missing words in the transcript, and can also resume playback from the point where typing stopped, which might be earlier than the point that speech playback was last stopped, or from a few words before that point, thus repeating the missed (un-typed) part of the speech.

Another feature of one preferred implementation of the module 14 is shown at decision diamond 56, wherein it is determined whether a soon to be played, read ahead audio segment contains no speech. If so, the segment can be skipped over and not played by the audio system 24 at block 58. Certain speech recognition modules 18 can identify individual speakers, so that at decision diamond 60 it can be determined whether a new speaker is the source for the audio about to be played. If so, the transcribed text can be highlighted or otherwise indicated as being from a new speaker at block 62. The monitoring loop repeats at state 64. If desired, the typist can specify the automatic reaction preferred for each case (e.g., underlining instead of highlighting a new speaker), set a default speed, speed up the speech while increasing the pause between sentences or vice-versa.

When a speech recognition module 18 is provided, automatic error detection/notification and/or word completion can be undertaken by the adaptive module 14 based on a prefix already typed and the speech recognition result. In such a case, the speech recognition module 18 can also determine between one of several alternative interpretations of an audio segment based on the corresponding transcript.

While the particular SYSTEM AND METHOD FOR ADAPTING SPEECH PLAYBACK SPEED TO TYPING SPEED as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiment which may become obvious to those skilled in the art, and that the scope of the present invention is accordingly to be limited by nothing other than the appended claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for" or, in the case of a method claim, the element is recited as a "step" instead of an "act".

We claim:

1. A computer-implemented method for facilitating efficient transcription of audible speech from an audio system, comprising:

measuring a typing speed;

generating a signal based on the typing speed;

using the signal to establish a rate at which the audible speech is played by the audio system; and assigning each word in recognized speech with a respective expected typing duration by a predetermined user, for facilitating estimating the typing rate.

2. The method of claim 1, wherein the signal represents a playback rate correction.

3. The method of claim 1, wherein the act of establishing the rate includes:

detecting a user-initiated pause in the audio system, and in response thereto reducing a playback rate; and/or detecting a continuous period of typing at least a first predetermined time period in length characterized by having pause periods all less than a second predetermined time period, and in response increasing the playback rate.

4. The method of claim 1, wherein the act of establishing the rate includes:

determining a number of words typed per a unit time, and establishing a playback rate based thereon.

5. The method of claim 1, wherein the act of establishing the rate includes:

determining a number of characters typed per a unit time, and establishing a playback rate based thereon.

6. The method of claim 1, wherein the act of establishing the rate includes:

determining a number of phonemes typed per a unit time, and establishing a playback rate based thereon.

7. The method of claim 1, further comprising reading ahead audio before it is played, such that the act of establishing the rate at which the audible speech is played is undertaken before the speech is played.

8. The method of claim 1, further comprising detecting a typing pause having at least a predetermined duration, and automatically stopping playback of the audio in response thereto.

9. The method of claim 1, further comprising:

detecting a stroke of a predetermined key; and causing the audio system to replay audio in response to the stroke.

10. The method of claim 1, wherein the rate at which the audible speech is played is established using at least one of: time scale modification (TSM), inserting pauses between words, inserting pauses between sentences.

11. The method of claim 1, wherein the audible speech is part of an audio stream, and the method includes skipping non-speech parts of the audio stream.

12. The method of claim 1, further comprising using speech recognition for automatic error detection and/or word completion.

13. The method of claim 1, further comprising detecting a change of speaker making the audible speech, and marking the change in response.

14. A computer program product to undertake logic for dynamically establishing a playback rate of an audio system, the logic including:

logic means for receiving manual input representing a transcription of audio having a playback rate;

logic means for determining a typing speed based on the means for receiving;

logic means for using the typing speed to establish a playback rate; and assigning each word in recognized speech with a respective expected typing duration by a predetermined user, for facilitating estimating the typing rate.

15. The computer program product of claim 14, further comprising:

logic means for detecting a user-initiated pause in the audio system, and in response thereto reducing the playback rate; and/or logic means for detecting a continuous period of typing at least a first predetermined time period in length characterized by having pause periods all less than a second predetermined time period, and in response increasing the playback rate.

16. The computer program product of claim 14, wherein the means for using includes:

logic means for determining a number of words typed per a unit time, and establishing the playback rate based thereon.

17. The computer program product of claim 14, wherein the means for using includes:

logic means for determining a number of characters or phonemes typed per a unit time, and establishing the playback rate based thereon.

18. The computer program product of claim 14, further comprising logic means for reading ahead audio before it is played.

19. The computer program product of claim 14, further comprising logic means for detecting a typing pause having at least a predetermined duration, and automatically stopping playback of the audio in response thereto.

20. The computer program product of claim 14, further comprising:

logic means for detecting a stroke of a predetermined key; and logic means for causing the audio system to replay audio in response to the stroke.

21. The computer program product of claim 14, wherein the audio is part of an audio stream, and the product includes logic means for skipping non-speech parts of the audio stream.

22. The computer program product of claim 14, further comprising logic means for using speech recognition for automatic error detection and/or word completion.

23. The computer program product of claim 14, further comprising logic means for detecting a change of speaker making the audio, and marking the change in response.

24. An audio transcription computer system, comprising:

at least one computer including a module having logical structure to determine typing speed;

at least one audio system receiving feedback representative of typing speed from the computer and in response applying an audio playback rate to audio; and assigning each word in recognized speech with a respective expected typing duration by a predetermined user, for facilitating estimating the typing rate.

25. The system of claim 24, wherein the audio system includes at least one time scale modification device applying the playback rate to audio, and the feedback from the module establishes the playback rate.

26. The system of claim 25, wherein the module determines typing speed at least in part by:

detecting a user-initiated pause in the audio system, and in response thereto reducing the playback rate; and/or detecting a continuous period of typing at least a first predetermined time period in length characterized by having pause periods all less than a second predetermined time period, and in response increasing the playback rate.

27. The system of claim 25, wherein the module determines typing speed at least in part by determining a number of words or phonemes or characters typed per a unit time, and establishing the playback rate based thereon.

28. The system of claim 25, wherein the time scale modification device applies the playback rate to read ahead audio.

29. The system of claim 25, wherein the computer detects a typing pause having at least a predetermined duration, and causes the audio system to automatically stop playback of the audio in response thereto.

30. The system of claim 25, wherein the computer detects a stroke of a predetermined key, and causes the audio system to replay audio in response thereto.

31. The system of claim 25, further comprising a speech recognition module for undertaking at least one of: automatic word completion based on a prefix already typed and a speech recognition result, and determining between one of several alternative interpretations of an audio segment based on a corresponding transcript.

32. The system of claim 24, wherein the audio is part of an audio stream, and the module skips non-speech parts of the audio stream.

33. The system of claim 24, wherein the module uses speech recognition for automatic error detection and/or word completion.

34. The system of claim 24, wherein the module detects a change of speaker making the audio, and marks the change in response.

35. A computer-implemented method for facilitating efficient transcription of audible speech from an audio system, comprising:

measuring a typing rate;

measuring a speech rate;

generating a signal based on the typing rate and speech rate;

using the signal to establish a rate at which the audible speech is played by the audio system; and assigning each word in recognized speech with a respective expected typing duration by a predetermined user, for facilitating estimating the typing rate.

36. The method of claim 35, wherein the signal represents a playback rate correction.

37. The method of claim 35, wherein the act of establishing the typing rate includes:

detecting a user-initiated pause in the audio system, and in response thereto reducing a playback rate; and/or detecting a continuous period of typing at least a first predetermined time period in length characterized by having pause periods all less than a second predetermined time period, and in response increasing the playback rate.

38. The method of claim 35, wherein the act of establishing the typing rate includes:

determining a number of words typed per a unit time, and establishing a playback rate based thereon.

39. The method of claim 35, wherein the act of establishing the typing rate includes:

determining a number of characters typed per a unit time, and establishing a playback rate based thereon.

40. The method of claim 35, wherein the act of establishing the typing rate includes:

determining a number of phonemes typed per a unit time, and establishing a playback rate based thereon.

41. The method of claim 35, further comprising reading ahead audio before it is played, such that the act of establishing the rate at which the audible speech is played is undertaken before the speech is played.

42. The method of claim 35, further comprising detecting a typing pause having at least a predetermined duration, and automatically stopping playback of the audio in response thereto.

43. The method of claim 35, further comprising:

detecting a stroke of a predetermined key; and causing the audio system to replay audio in response to the stroke.

44. The method of claim 35, wherein the audible speech is part of an audio stream, and the method includes skipping non-speech parts of the audio stream.

45. The method of claim 35, further comprising using speech recognition for automatic error detection and/or word completion.

46. The method of claim 35, further comprising detecting a change of speaker making the audible speech, and marking the change in response.

47. The method of claim 35, further comprising using speech recognition to determine words spoken per second, or phonemes spoken per second, or characters spoken per second, or approximations thereof.

48. A computer system for facilitating efficient transcription of audible speech from an audio system, comprising:

means for measuring a typing rate;

means for measuring a speech rate;

means for generating a signal based on the typing rate and speech rate;

means for using the signal to establish a rate at which the audible speech is played by the audio system; and assigning each word in recognized speech with a respective expected typing duration by a predetermined user, for facilitating estimating the typing rate.

49. The system of claim 48, wherein the signal represents a playback rate correction.

50. The system of claim 48, further comprising:

means for detecting a user-initiated pause in the audio system, and in response thereto reducing a playback rate; and/or means for detecting a continuous period of typing at least a first predetermined time period in length characterized by having pause periods all less than a second predetermined time period, and in response increasing the playback rate.

51. The system of claim 48, further comprising:

means for determining a number of words typed per a unit time, and establishing a playback rate based thereon.

52. The system of claim 48, further comprising:

means for determining a number of characters typed per a unit time, and establishing a playback rate based thereon.

53. The system of claim 48, further comprising:

means for determining a number of phonemes typed per a unit time, and establishing a playback rate based thereon.

54. The system of claim 48, further comprising means for reading ahead audio before it is played, such that the means for establishing the rate at which the audible speech is played is executed before the speech is played.

55. The system of claim 48, further comprising means for detecting a typing pause having at least a predetermined duration, and automatically stopping playback of the audio in response thereto.

56. The system of claim 48, further comprising:

means for detecting a stroke of a predetermined key; and means for causing the audio system to replay audio in response to the stroke.

57. The system of claim 48, wherein the audible speech is part of an audio stream, and the system includes means for skipping non-speech parts of the audio stream.

58. The system of claim 48, further comprising means for using speech recognition for automatic error detection and/or word completion.

59. The system of claim 48, further comprising means for detecting a change of speaker making the audible speech, and marking the change in response.

60. The system of claim 48, further comprising means for using speech recognition to determine words spoken per second, or phonemes spoken per second, or characters spoken per second, or approximations thereof.

* * * * *